US005511517A

United States Patent [19]

Perry et al.

[11] Patent Number: 5,511,517

[45] Date of Patent: Apr. 30, 1996

[54] REDUCING EXHAUST EMISSIONS FROM OTTO-CYCLE ENGINES

[75] Inventors: Newton A. Perry, Richmond, Va.; Joseph W. Roos, Baton Rouge, La.

[73] Assignee: Ethyl Corporation, Richmond, Va.

[21] Appl. No.: 195,857

[22] Filed: Feb. 10, 1994

[51] Int. Cl.[6] ..... F02B 75/12

[52] U.S. Cl. ..... 123/1 A; 123/198 A; 44/359

[58] Field of Search ..... 123/1 A, 198 A; 44/359, 360

[56] References Cited

U.S. PATENT DOCUMENTS

| | | | |
|---|---|---|---|
| Re. 29,488 | 12/1977 | Gautreaux | 44/68 |
| 2,818,417 | 12/1957 | Brown et al. | 260/429 |
| 2,953,587 | 9/1960 | Clinton et al. | 260/429 |
| 3,015,668 | 1/1962 | Kozikowski | 260/429 |
| 3,112,789 | 12/1963 | Percy et al. | 158/117.5 |
| 3,127,351 | 3/1964 | Brown et al. | 252/49.7 |
| 3,197,414 | 7/1965 | Wood | 252/386 |
| 3,307,928 | 3/1967 | Chaikivsky et al. | 44/63 |
| 3,582,295 | 6/1971 | Balash | 44/63 |
| 3,755,195 | 8/1973 | Hnizda | 252/386 |
| 3,849,083 | 11/1974 | Dubeck | 44/72 |
| 3,883,320 | 5/1975 | Strukl | 44/68 |

(List continued on next page.)

FOREIGN PATENT DOCUMENTS

| | | |
|---|---|---|
| 0078249 | 5/1983 | European Pat. Off. . |
| 0466511 | 1/1992 | European Pat. Off. . |
| 0476196 | 3/1992 | European Pat. Off. . |
| 1413323 | 11/1975 | United Kingdom . |
| 8701384 | 3/1987 | WIPO . |
| 8905339 | 6/1989 | WIPO . |

OTHER PUBLICATIONS

Zubarev et al, "Lowering Carbon Deposition in Ship Diesels", Rybn. Khoz. (Moscow), vol. 9, pp. 52–54 (1977).

Shmidt et al, "Use of manganese antiknock compound 2–Ts8 for improving the octane characteristics of gasoline", *Neftepererab. Neftekhim. (Moscow)* 1 (11), pp. 8–10 (1972).

Keszthelyi et al, "Testing the combustion properties of light fuel oils", *Period. Polytech., Chem. Eng.,* 21(1) pp. 77–93 (1977).

Borisov et al, "Features of the ignition of combustible liquid mixtures", *Dokl. Adak. Nauk SSSR,* 247(5), pp. 1176–1179 (1979).

Mutalibov et al, "Effect of additives on the combustion of fuel for internal–combustion engines", *Dokl. Akad. Naus SSSR,* 250(5) pp. 1194–1196 (1980).

Bartels et al, "Determination of tricarbonylcyclopentadienyl(methyl)manganese JP–4 fuel by atomic absorption spectrophotometry", *Atomic Absorption Newsletter,* 8(1) pp. 3–5 (1969).

Belyea, "The CI–2 Manganese Based Additive Reduces the Concentration of $SO_3$ In Flue Gases", *Il Calore* 1967, No. 3, pp. 135–137.

Makhov et al, "Effect of cyclopentadienyltricarbonylmanganese additives to diesel fuel on the course of the soot formation process", Margantsevye Antidetonatory, pp. 192–199 (1971).

*Primary Examiner*—Erick R. Solis

*Attorney, Agent, or Firm*—Dennis H. Rainear; William H. Thrower

[57] ABSTRACT

The amount of nitrogen oxide (NOx) and hydrocarbon emissions emanating via the exhaust during operation of a gasoline engine is reduced by dispensing to a gasoline engine adjusted to operate primarily at an air-to-fuel ratio between lambda of about 0.9 to about 1.15, a gasoline that contains a minor amount of (i) a cyclopentadienyl manganese tricarbonyl compound and (ii) an alkyllead anti-knock agent. Components (i) and (ii) are proportioned such that there is dissolved in the fuel a substantially equal weight of manganese as (i) and lead as (ii), and the amount of (i) and (ii) used in the fuel is an amount that reduces the amount of NOx and hydrocarbons in the engine exhaust on combustion of the fuel with an air-to-fuel ratio between lambda of about 0.9 to about 1.15. Lambda is the actual air-to-fuel ratio divided by the stoichiometric air-to-fuel ratio. The stoichiometric air-to-fuel ratio is a lambda value of one.

14 Claims, 3 Drawing Sheets

U.S. PATENT DOCUMENTS

Figure 1:
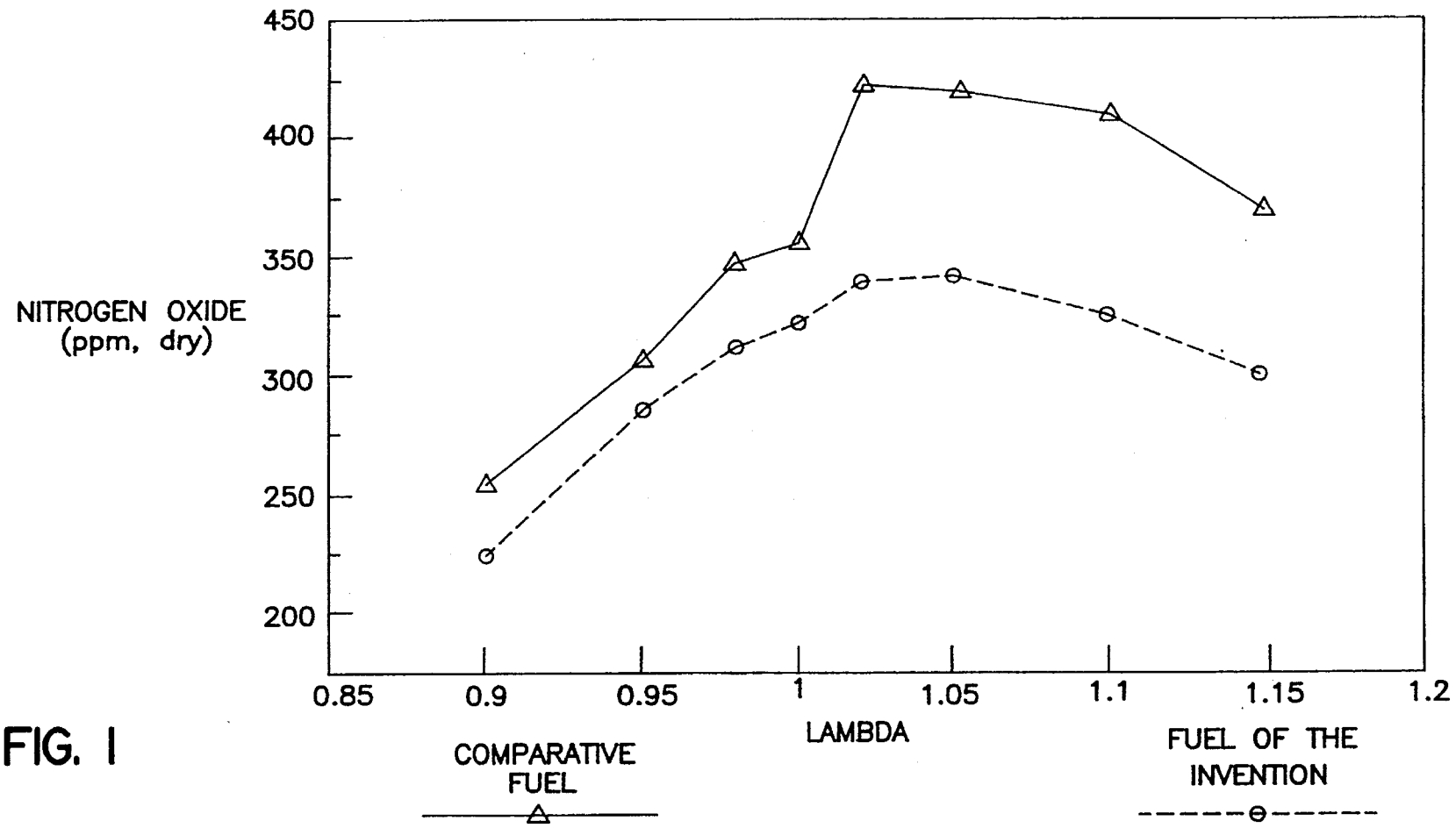

| | | | |
|---|---|---|---|
| 3,891,401 | 6/1975 | Watson et al. | 44/68 |
| 3,994,698 | 11/1976 | Worrel | 44/58 |
| 4,005,993 | 1/1977 | Niebylski | 44/56 |
| 4,047,900 | 9/1977 | Dorn et al. | 44/68 |
| 4,082,517 | 4/1978 | Niebylski et al. | 44/68 |
| 4,117,011 | 9/1978 | Malec | 44/72 |
| 4,139,349 | 2/1979 | Payne | 44/68 |
| 4,141,693 | 2/1979 | Feldman et al. | 44/68 |
| 4,175,927 | 11/1979 | Niebylski | 44/68 |
| 4,191,536 | 3/1980 | Niebylski | 44/63 |
| 4,207,078 | 6/1980 | Sweeney et al. | 44/68 |
| 4,240,801 | 12/1980 | Desmond, Jr. | 44/57 |
| 4,280,458 | 7/1981 | Kiovsky | 123/198 A |
| 4,317,657 | 3/1982 | Niebylski | 44/66 |
| 4,390,345 | 6/1983 | Somorjai | 44/63 |
| 4,437,436 | 3/1984 | Graiff et al. | 123/1 A |
| 4,674,447 | 6/1987 | Davis | 123/1 A |
| 5,113,803 | 5/1992 | Hollrah et al. | 123/1 A |

REDUCING EXHAUST EMISSIONS FROM OTTO-CYCLE ENGINES

This invention relates to a new way of minimizing exhaust emissions from spark-ignition internal combustion engines operated on gasoline-type fuels.

In many parts of the world it is necessary and thus conventional practice to increase the octane value of the available base gasolines by use therein of a suitable quantity of tetraethyllead. One objective of this invention is to reduce the amount of nitrogen oxide (NOx) emissions and hydrocarbon emissions emanating via the exhaust of gasoline engines as compared to the amount of these emissions produced when operating in accordance with such conventional practice with a fuel of the same or similar octane quality. Another objective is to achieve the foregoing reductions of exhaust emissions while concurrently avoiding, or at least reducing, exhaust valve recession in engines susceptible to exhaust valve recession when operated on unleaded gasoline. Still another objective is to achieve the foregoing advantageous emission control results while at the same time achieving the required fuel octane quality by use of fuels having a reduced metal content.

To accomplish one or more of the foregoing objectives, there is dispensed to the Otto-cycle engine a gasoline fuel that contains a minor amount of (i) a cyclopentadienyl manganese tricarbonyl compound and (ii) an alkyllead antiknock agent, wherein (i) and (ii) are proportioned such that there is dissolved in said fuel a substantially equal weight of manganese as (i) and lead as (ii), and wherein said minor amount of (i) and (ii) is sufficient to reduce the amount of NOx and hydrocarbons in the engine exhaust on combustion of said fuel with an air-to-fuel ratio between lambda of about 0.9 to about 1.15, where lambda is the actual air-to-fuel ratio divided by the stoichiometric air-to-fuel ratio. The lambda value for the stoichiometric air-to-fuel ratio is one. Results to date from test work on this invention indicate that by dispensing the foregoing fuel composition to a gasoline engine adjusted to operate at least primarily at air-to-fuel ratios between lambda of about 0.9 to about 1.15, it is possible pursuant to this invention to reduce both NOx and hydrocarbon emissions in the engine exhaust by an average of 14.6% and 26%, respectively. The greatest reductions in NOx emissions at comparable fuel octane levels tends to occur at operation with an air-to-fuel ratio between lambda of about 1.02 and about 1.15, and the lowest absolute levels of NOx emissions tend to occur pursuant to this invention at air-to-fuel ratios between lambda of about 0.9 and about 0.95. The greatest reductions in hydrocarbon exhaust emissions at comparable fuel octane levels tends to occur at operation with an air-to-fuel ratio between lambda of about 1.03 to about 1.15, although very substantial reductions also occur between lambda of about 0.95 to about 1.03. For best results on reduction and control of both NOx and hydrocarbon exhaust emissions, the fuel is preferably dispensed to a gasoline engine adjusted to operate primarily between lambda of about 1.0 to about 1.15. Over this same range of between lambda of about 1.0 to about 1.15, the amount of carbon monoxide emissions is also kept low.

Accordingly, this invention involves, inter alia, use of a gasoline-type fuel containing a minor exhaust-emission reducing amount of (i) a cyclopentadienyl manganese tricarbonyl compound and (ii) a lead alkyl antiknock agent, wherein (i) and (ii) are proportioned such that there is dissolved in said fuel a substantially equal weight of manganese as (i) and lead as (ii), in a gasoline engine to control the amount of NOx and hydrocarbons in the exhaust gas emanating from a gasoline engine adjusted to operate primarily at an air to fuel ratio between lambda of about 0.9 to about 1.15.

By "substantially equal weight of manganese as (i) and lead as (ii)" is meant that the weights of manganese and lead provided by components (i) and (ii), respectively, do not differ from each other by more than 20%. Preferably these weights differ by no more than 10%. Most preferably the weights do not differ from each other by more than 2%, and thus the weights in this case, for all practical purposes, are the same.

As noted above, the engines in which the foregoing fuel composition is used are adjusted to operate primarily at air-to-fuel ratios between the lambda values specified above. By "primarily" is meant that in normal operation of the engine it is operating with air-to-fuel ratios in the lambda range specified for over 50% of the total time between engine start-up and engine shut down. Preferably the engine is adjusted to operate within the lambda range herein specified for at least 60%, and more preferably, at least 75%, of the total time between engine start-up and engine shut down. In the practice of this invention, the greater the percentage of time the engine operates within the lambda range herein specified, the greater will be the reduction of the exhaust emissions as compared to a conventional leaded fuel of the same octane quality.

Figure 2:
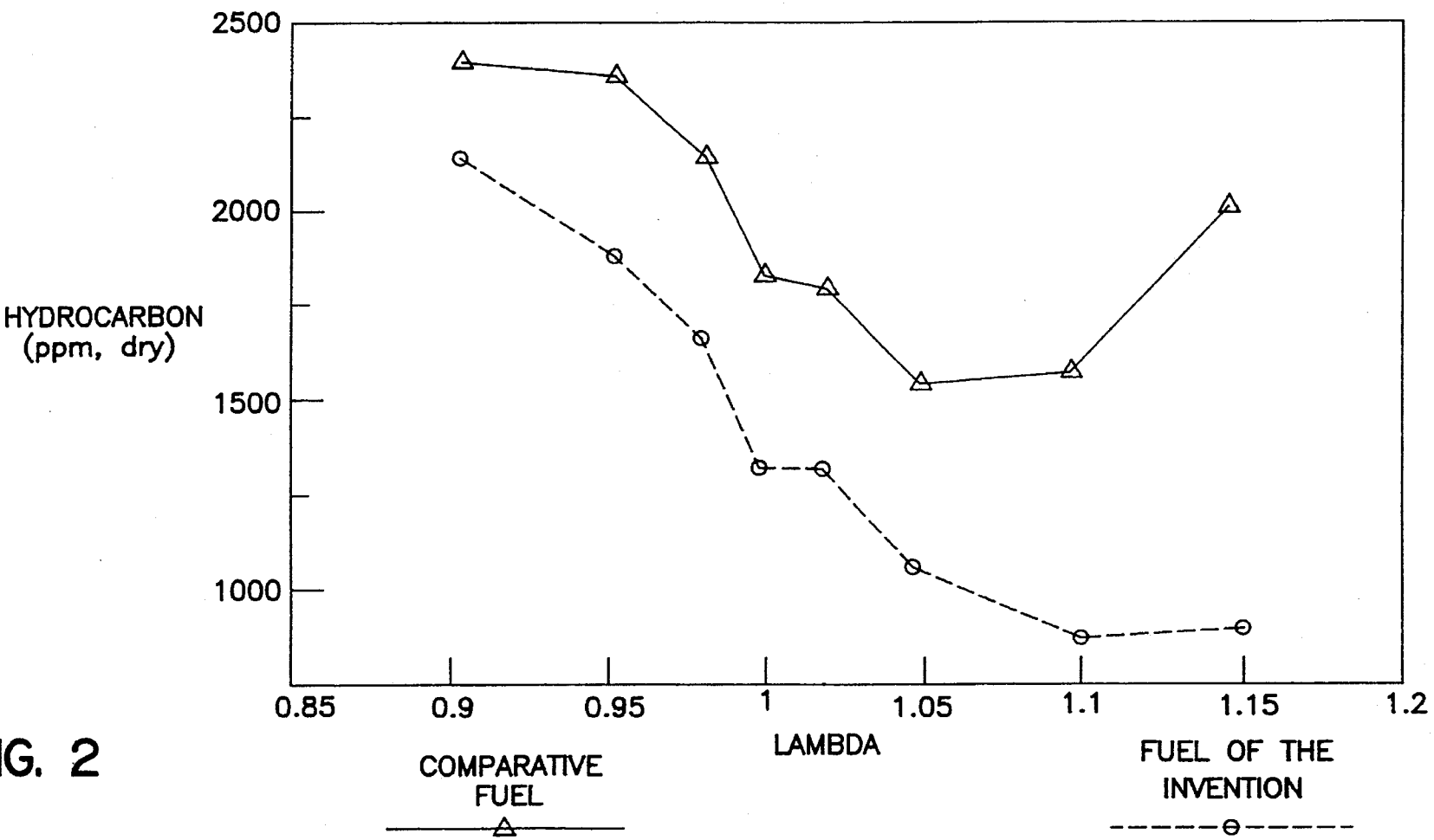
Figure 3:
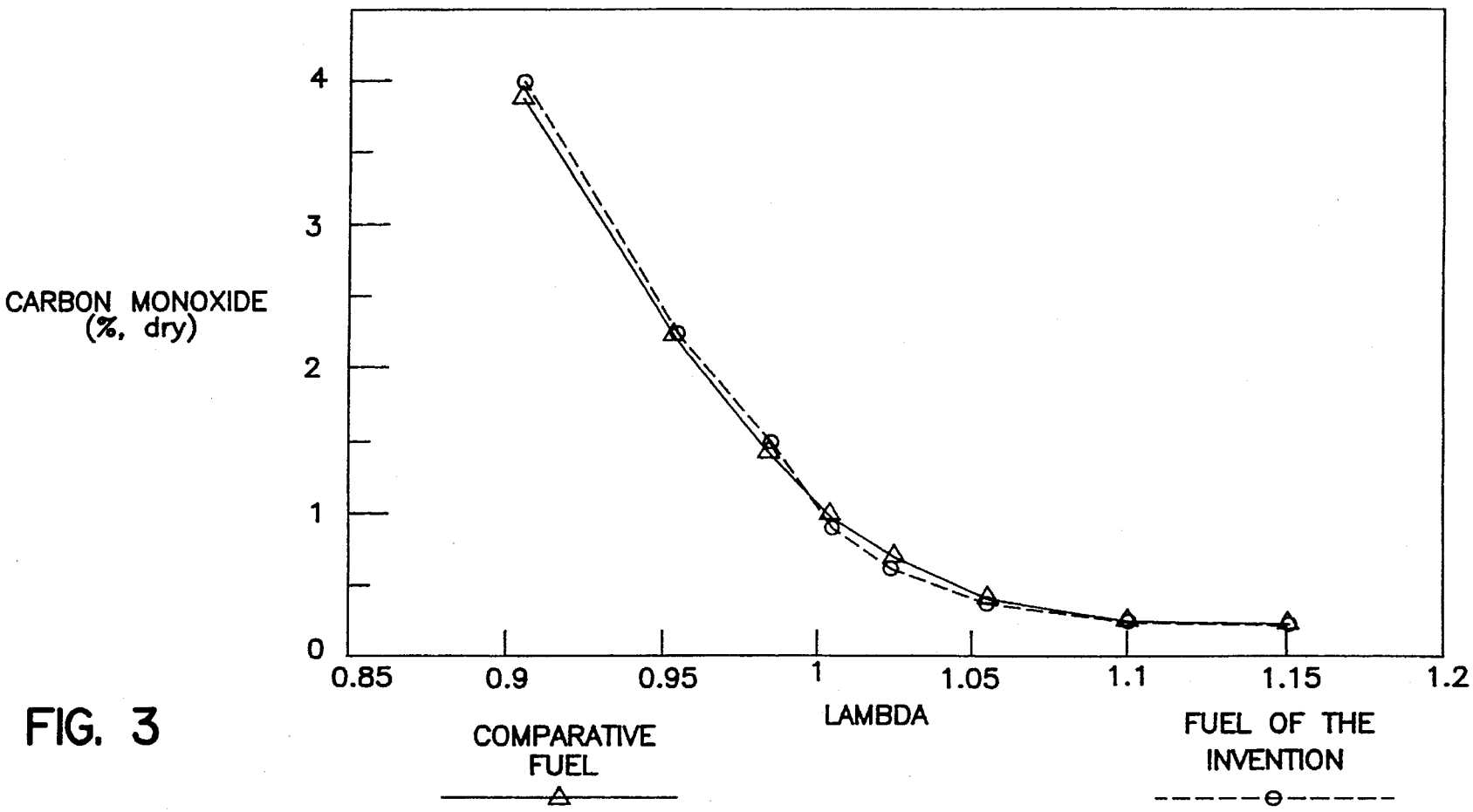

FIG. 1,2 and 3 present in graphical form the results of certain emission tests described hereinafter.

The gasolines utilized in the practice of this invention can be traditional blends or mixtures of hydrocarbons in the gasoline boiling range, or they can contain oxygenated blending components such as alcohols and/or ethers having suitable boiling temperatures and appropriate fuel solubility, such as methanol, ethanol, methyl tert-butyl ether (MTBE), ethyl tert-butyl ether (ETBE), tert-amyl methyl ether (TAME), and mixed oxygen-containing products formed by "oxygenating" gasolines and/or olefinic hydrocarbons falling in the gasoline boiling range. Thus this invention involves use of gasolines, including the so-called reformulated gasolines which are designed to satisfy various governmental regulations concerning composition of the base fuel itself, componentry used in the fuel, performance criteria, toxicological considerations and/or environmental considerations. The amounts of oxygenated components, detergents, antioxidants, demulsifiers, and the like that are used in the fuels can thus be varied to satisfy any applicable government regulations, provided that in so doing the amounts used do not materially impair the exhaust emission control performance made possible by the practice of this invention. Use in the practice of this invention of gasoline containing one or more fuel-soluble ethers and/or other oxygenates in amounts in the range of up to about 20% by weight, and preferably in the range of about 5 to 15% by weight constitutes a preferred embodiment of this invention. The properties of a typical traditional type hydrocarbonaceous gasoline devoid of any additive or oxygenated blending agent are set forth in the following Table I.

TABLE I

| Property | Test Method | Value |
|---|---|---|
| IBP | ASTM D86 | 30° C. |
| 5% | ASTM D86 | 42° C. |
| 10% | ASTM D86 | 51° C. |
| 20% | ASTM D86 | 60° C. |
| 30% | ASTM D86 | 71° C. |
| 40% | ASTM D86 | 86° C. |

TABLE I-continued

| Property | Test Method | Value |
|---|---|---|
| 50% | ASTM D86 | 103° C. |
| 60% | ASTM D86 | 114° C. |
| 70% | ASTM D86 | 124° C. |
| 80% | ASTM D86 | 140° C. |
| 90% | ASTM D86 | 165° C. |
| 95% | ASTM D86 | 187° C. |
| FBP | ASTM D86 | 222° C. |
| RVP | ASTM D323 | 7.4 psi |
| Sulfur | ASTM D3120 | 199 ppm wt |
| Gravity | ASTM D287 | 54.8° API |
| Oxidation Stability | ASTM D525 | 1440 minutes |
| Gum Content, washed | ASTM D381 | 0.4 mg/100 mL |
| Gum Content, unwashed | ASTM D381 | 2.0 mg/100 mL |

A typical oxygenated base gasoline fuel blend containing 12.8% by volume of methyl tert-butyl ether has the characteristics given in Table II.

TABLE II

| Property | Test Method | Value |
|---|---|---|
| Density at 15° C. | ASTM D4052 | 0.772 kg/L |
| IBP | ASTM D86 | 42° C. |
| 10% | ASTM D86 | 63° C. |
| 50% | ASTM D86 | 106° C. |
| 90% | ASTM D86 | 154° C. |
| FBP | ASTM D86 | 199° C. |
| % Off at 70° C. | ASTM D86 | 16 vol % |
| % Off at 100° C. | ASTM D86 | 45 vol % |
| % Off at 180° C. | ASTM D86 | 98 vol % |
| RON | ASTM D2699/86 | 97.2 |
| MON | ASTM D2700/86 | 86.0 |
| RVP | ASTM D323 | 0.49 bar |
| Sulfur | ASTM D3120 | <0.01% |
| Aromatics | ASTM D1319 | 46.9 vol % |
| Olefins | ASTM D1319 | 2.4 vol % |
| Saturates | ASTM D1319 | 50.8 vol % |

Component (i). Illustrative cyclopentadienyl manganese tricarbonyl compounds suitable for use in the practice of this invention include such compounds as cyclopentadienyl manganese tricarbonyl, methylcyclopentadienyl manganese tricarbonyl, dimethylcyclopentadienyl manganese tricarbonyl, trimethylcyclopentadienyl manganese tricarbonyl, tetramethylcyclopentadienyl manganese tricarbonyl, pentamethylcyclopentadienyl manganese tricarbonyl, ethylcyclopentadienyl manganese tricarbonyl, diethylcyclopentadienyl manganese tricarbonyl, propylcyclopentadienyl manganese tricarbonyl, isopropylcyclopentadienyl manganese tricarbonyl, tert-butylcyclopentadienyl manganese tricarbonyl, octylcyclopentadienyl manganese tricarbonyl, dodecylcyclopentadienyl manganese tricarbonyl, ethylmethylcyclopentadienyl manganese tricarbonyl, indenyl manganese tricarbonyl, and the like, including mixtures of two or more such compounds. Preferred are the cyclopentadienyl manganese tricarbonyls which are liquid at room temperature such as methylcyclopentadienyl manganese tricarbonyl, ethylcyclopentadienyl manganese tricarbonyl, liquid mixtures of cyclopentadienyl manganese tricarbonyl and methylcyclopentadienyl manganese tricarbonyl, mixtures of methylcyclopentadienyl manganese tricarbonyl and ethylcyclopentadienyl manganese tricarbonyl, etc. Preparation of such compounds is described in the literature, e.g., U.S. Pat No. 2,818,417.

Component (ii). Illustrative alkyllead antiknock compounds suitable for use in this invention include tetramethyllead, methyltriethyllead, dimethyldiethyllead, trimethylethyllead, tetraethyllead, tripropyllead, dimethyldiisopropyllead, tetrabutyllead, and related fuel-soluble tetraalkyllead compounds in which each alkyl group has up to about six carbon atoms. The preferred compound is tetraethyllead. Preparation of such compounds is described in the literature, e.g., U.S. Pat. Nos. 2,727,052; 2,727,053; 3,049,558; and 3,231,510. The alkyllead compound can be used in admixture with halogen scavengers in the manner described for example in such patents as U.S. Pat. Nos. 2,398,281; 2,479,900; 2,479,901; 2,479,902; 2,479,903; and 2,496,983. Alternatively, the alkyllead compound can be used without any halogen scavenger such as is described for example in U.S. Pat. Nos. 3,038,792; 3,038,916; 3,038,917; 3,038,918 and 3,038,9. In either case, a suitable oxidation inhibitor or stabilizer can be associated with the alkyllead compound, such as is described for example in U.S. Pat. Nos. 2,836,568; 2,836,609 and 2,836,610.

EXAMPLES

In order to demonstrate the remarkable results achievable by the practice of this invention, a series of standard tests was conducted using a pulse flame combustion apparatus, a laboratory scale combustion device that has been widely used to study fuel effects on exhaust emissions. The device has been shown to qualitatively simulate the emission performance of spark ignition internal combustion engines under a wide variety of operating conditions. The base fuel used forming the test fuels was a commercially available unleaded regular gasoline. The fuel for the practice of this invention contained 0.1 gram of lead per gallon as tetraethyllead and 0.1 gram of manganese per gallon as methylcyclopentadienyl manganese tricarbonyl. In addition, the fuel contained 0.5 theory of bromine as ethylene dibromide and 1.0 theory of chlorine as ethylene dichloride, a theory being two atoms of halogen per atom of lead as the tetraethyllead.

Emission levels for the fuels tested were evaluated over a range of rich to lean combustion conditions extending from a lambda of 0.9 to a lambda of 1.15. This air-to-fuel ratio sweep involved making determinations of emissions at eight individual air-to-fuel ratios covering the foregoing lambda range of 0.9 to 1.15. Each determination at a given lambda value was carried out in duplicate. An overall emission value was calculated for the fuels by averaging the emissions measured at each point in the range of air-to-fuel ratios used.

For comparative purposes, use was made of a fuel composition made from the same base fuel so as to directly simulate a fuel in wide-spread use in Mexico City. This fuel contained 0.3 grams of lead per gallon. Consequently, the results obtained provide a comparative evaluation of a real-world situation at comparable octane levels, and the benefits of that are achievable by the practice of this invention.

It was found that nitrogen oxide emissions were reduced over the entire range of air-to-fuel ratios between a lambda value of 0.9 to a lambda value of 1.15. As compared to the comparative fuel simulating use in Mexico City, a relative reduction in emissions was observed that was significant at least at the 95% statistical confidence level at all air-to-fuel lambda values tested except at stoichiometry. It was also found that in the practice of this invention, hydrocarbon emissions were minimized at all air-to-fuel ratios tested.

Once again, as compared to the above comparative fuel, the relative reduction was statistically significant at least at the 95% confidence level at all air-to-fuel ratios tested except at the richest condition at a lambda value of 0.9. Throughout the range of these comparative tests, there was no material difference in carbon monoxide emissions. The results of all of these tests are tabulated in Tables III, IV and V below and depicted graphically in FIGS. 1, 2 and 3.

TABLE III

| | NOx Emissions, ppm | |
|---|---|---|
| Lambda Value | Conventional Practice | Practice of the Invention |
| 0.90 | 257 | 227 |
| 0.95 | 309 | 288 |
| 0.98 | 350 | 315 |
| 1.00 | 358 | 325 |
| 1.02 | 423 | 342 |
| 1.05 | 420 | 345 |
| 1.10 | 411 | 330 |
| 1.15 | 373 | 305 |

TABLE IV

| | Hydrocarbon Emissions, ppm | |
|---|---|---|
| Lambda Value | Conventional Practice | Practice of the Invention |
| 0.90 | 2400 | 2173 |
| 0.95 | 2373 | 1942 |
| 0.98 | 2184 | 1747 |
| 1.00 | 1900 | 1433 |
| 1.02 | 1870 | 1438 |
| 1.05 | 1640 | 1203 |
| 1.10 | 1674 | 976 |
| 1.15 | 2086 | 1020 |

TABLE V

| | Carbon Monoxide Emissions, % | |
|---|---|---|
| Lambda Value | Conventional Practice | Practice of the Invention |
| 0.90 | 3.830 | 3.940 |
| 0.95 | 2.190 | 2.245 |
| 0.98 | 1.420 | 1.490 |
| 1.00 | 0.975 | 0.915 |
| 1.02 | 0.725 | 0.660 |
| 1.05 | 0.450 | 0.430 |
| 1.10 | 0.260 | 0.245 |
| 1.15 | 0.230 | 0.210 |

An overall emission value was calculated for the fuels by averaging the emissions measured at each point in the range of air-to-fuel ratios used. Table VI summarizes these averaged emission data.

TABLE VI

| Emission Type | Conventional Practice | Practice of the Invention |
|---|---|---|
| NOx (ppm, dry) | 362 | 309 |
| Hydrocarbon (ppm, dry) | 2015 | 1491 |
| Carbon Monoxide (%, dry) | 1.26 | 1.27 |

A transient method was also used to compare emissions resulting from practice of the invention as compared to conventional practice. In these transient tests, the air-to-fuel ratio was changed periodically by about 3% in a square wave around the stoichiometric point. In one test, the period for the perturbation was seconds and in another test, the period was reduced to 10 seconds. For both tests emissions were measured continuously over several minutes of the switching and an average value was calculated. The average values obtained from these transient tests are summarized in Tables VII and VIII.

TABLE VII

| | 30 Second Perturbation Periods | |
|---|---|---|
| Emission Type | Conventional Practice | Practice of the Invention |
| NOx (ppm, dry) | 378 | 326 |
| Hydrocarbon (ppm, dry) | 2097 | 1943 |
| Carbon Monoxide (%, dry) | 1.13 | 1.06 |

TABLE VIII

| | 10 Second Perturbation Periods | |
|---|---|---|
| Emission Type | Conventional Practice | Practice of the Invention |
| NOx (ppm, dry) | 375 | 331 |
| Hydrocarbon (ppm, dry) | 2078 | 1852 |
| Monoxide (%, dry) | 1.04 | 0.94 |

As can be seen from the above results the fuel used in the practice of this invention can contain very small amounts of manganese and lead. In the fuels for the practice of this invention, the total amount of these metals, proportioned as specified hereinabove and dissolved in the fuel in the form of components (i) and (ii), will usually be maintained within the range of about 0,025 to about 0.5 gram per U.S. gallon of fuel. Preferably, the total amount of these metals in the form of components (i) and (ii) will be maintained within the range of about 0.05 to about 0.3, and more preferably in the range of about 0.1 to about 0.25, gram per U.S. gallon of fuel. In all cases however, the particular amount and proportions of components (i) and (ii) in the particular gasoline fuel used in operating the Otto-cycle engine in the manner described hereinabove must be such as to reduce the amount of NOx and hydrocarbon emissions as compared to the same base fuel containing a higher concentration of the alkyllead compound but no cyclopentadienyl manganese tricarbonyl compound.

Particularly preferred fuel compositions for use in the practice of this invention contain about 0.08 to about 0.12 gram (more preferably about 0.1 gram) of manganese per U.S. gallon as the cyclopentadienyl manganese tricarbonyl compound, and about 0.08 to about 0.12 gram (more preferably about 0.1 gram) per U.S. gallon of lead as the tetraalkyllead compound. Other particularly preferred fuel compositions for use in the practice of this invention contain (i) about 0.08 to about 0.12 gram (more preferably about 0.1 gram) of manganese per U.S. gallon as the cyclopentadienyl manganese tricarbonyl compound, (ii) about 0.08 to about 0.12 gram (more preferably about 0.1 gram) per U.S. gallon of lead as the tetraalkyllead compound, and (iii) about 5 to about 15 percent by volume (based on the total volume of the finished fuel) of a gasoline-soluble oxygen-containing blending agent, preferably an alcohol and/or an ether, and most preferably at least one fuel-soluble dialkyl ether having a total of at least 5 carbon atoms per molecule. It is contemplated that in the practice of this invention, use of fuels containing the oxygenated blending components (particularly the dialkyl ethers) together with the manganese and lead components will result in significant reductions in carbon monoxide emissions.

When utilizing the present invention in connection with motor vehicles, it preferred to employ the invention with vehicles devoid of an exhaust gas catalyst. However, it is possible to utilize the invention with vehicles equipped with lead-resistant exhaust catalysts, that is catalysts that do not materially lose activity even when exposed to lead during operation.

Any standard test procedure for measuring NOx and hydrocarbon emissions in the exhaust gas of an internal combustion engine can be used for this purpose provided that the method has been published in the literature. In the case of motor vehicles, the preferred methodology involves operating the vehicle on a chassis dynamometer (e.g., a Clayton Model ECE-50 with a direct-drive variable-inertia flywheel system which simulates equivalent weight of vehicles from 1000 to 8875 pounds in 125-pound increments) in accordance with the Federal Test Procedure (United States Code of Federal Regulations, Title 40, Part 86, Subparts A and B, sections applicable to light-duty gasoline vehicles). The exhaust from the vehicle is passed into a stainless steel dilution tunnel wherein it is mixed with filtered air. Samples for analysis are withdrawn from the diluted exhaust by means of a constant volume sampler (CVS) and are collected in bags (e.g., bags made from Tedlar resin) in the customary fashion. The Federal Test Procedure utilizes an urban dynamometer driving schedule which is 1372 seconds in duration. This schedule, in turn, is divided into two segments; a first segment of 505 seconds (a transient phase) and a second segment of 867 seconds (a stabilized phase). The procedure calls for a cold-start 505 segment and stabilized 867 segment, followed by a ten-minute soak then a hot-start 505 segment.

We claim:

1. A method of reducing the amount of nitrogen oxide (NOx) emissions and hydrocarbon emissions emanating via the exhaust of a gasoline engine during operation thereof, which method comprises dispensing to a gasoline engine adjusted to operate primarily at an air-to-fuel ratio between lambda of about 0.9 to about 1.15, a gasoline fuel that contains a minor amount of (i) a cyclopentadienyl manganese tricarbonyl compound and (ii) an alkyllead antiknock agent, wherein said compound and said agent are proportioned such that there is dissolved in said fuel a substantially equal weight of manganese as said compound and lead as said agent, and wherein said minor amount of said compound and said agent is sufficient to reduce the amount of NOx and hydrocarbons in the engine exhaust on combustion on said fuel with an air-to-fuel ratio between lambda of about 0.9 to about 1.15, where lambda is the actual air-to-fuel ratio divided by the stoichiometric air-to-fuel ratio, said stoichiometric air-to-fuel ratio being a lambda value of one.

2. A method in accordance with claim 1 wherein said engine is adjusted to operate primarily at an air-to-fuel ratio between lambda of about 1.0 to about 1.15.

3. A method in accordance with claim 1 wherein said fuel contains about 0.1 gram of manganese per U.S. gallon as (i) and about 0.1 gram of lead per U.S. gallon as (ii).

4. A method in accordance with claim 1 wherein (i) is methylcyclopentadienyl manganese tricarbonyl and (ii) is tetraethyllead.

5. A method in accordance with claim 1 wherein said engine is adjusted to operate primarily at an air-to-fuel ratio between lambda of about 1.0 to about 1.15, wherein said fuel contains about 0.1 gram of manganese per U.S. gallon as said compound and about 0.1 gram of lead per U.S. gallon as said agent, and wherein said compound is methylcyclopentadienyl manganese tricarbonyl and said agent is tetraethyllead.

6. A method in accordance with claim 1 wherein said engine is in a motor vehicle devoid of an exhaust gas catalyst.

7. A method in accordance with claim 1 wherein said fuel contains about 5 to about 15 percent by volume, based on the total volume of the fuel, of a gasoline-soluble oxygen-containing blending agent.

8. A method in accordance with claim 7 wherein said blending agent is an alcohol or an ether.

9. A method in accordance with claim 7 wherein said blending agent is a dialkyl ether.

10. A method in accordance with claim 7 wherein said engine is in a motor vehicle devoid of an exhaust gas catalyst.

11. A method in accordance with claim 1 wherein said engine is adjusted to operate at said air-to-fuel ratio for at least 75% of the total time between engine start up and engine shut down.

12. A method in accordance with claim 1 wherein said fuel contains about 5 to about 15 percent by volume, based on the total volume of the fuel, of a gasoline-soluble blending agent selected from the group consisting of alcohols and ethers; wherein said engine is in a motor vehicle devoid of an exhaust gas catalyst; and wherein said engine is adjusted to operate at said air-to-fuel ratio for at least 75% of the total time between engine start up and engine shut down.

13. A method of reducing the amount of nitrogen oxide (NOx) emissions emanating via the exhaust of a gasoline engine during operation thereof, which method comprises dispensing to a gasoline engine adjusted to operate primarily at an air-to-fuel ratio between lambda of about 0.9 to about 0.95, a gasoline fuel that contains a minor amount of (i) a cyclopentadienyl manganese tricarbonyl compound and (ii) an alkyllead antiknock agent, wherein said compound and said agent are proportioned such that there is dissolved in said fuel a substantially equal weight of manganese as said compound and lead as said agent, and wherein said minor amount of said compound and said agent is sufficient to reduce the amount of NOx in the engine exhaust on combustion of said fuel with an air-to-fuel ratio between lambda of about 0.9 to about 0.95, where lambda is the actual air-to-fuel ratio divided by the stoichiometric air-to-fuel ratio, said stoichiometric air-to-fuel ratio being a lambda value of one.

14. A method in accordance with claim 13 wherein said fuel contains about 5 to about 15 percent by volume, based on the total volume of the fuel, of a gasoline-soluble blending agent selected from the group consisting of alcohols and ethers; wherein said engine is in a motor vehicle devoid of an exhaust gas catalyst; and wherein said engine is adjusted to operate at said air-to-fuel ratio for at least 75% of the total time between engine start up and engine shut down.

* * * * *